US010438555B2

(12) United States Patent
Lee et al.

(10) Patent No.: US 10,438,555 B2
(45) Date of Patent: Oct. 8, 2019

(54) LIQUID CRYSTAL DISPLAY DEVICE IMPROVING DISPLAY QUALITY AND DRIVING METHOD THEREOF

(71) Applicant: Samsung Display Co., Ltd., Yongin-si, Gyeonggi-do (KR)

(72) Inventors: Hyochul Lee, Hwaseong-si (KR); Jiwon Kim, Hwaseong-si (KR); Hyeondo Park, Gwangmyeong-si (KR)

(73) Assignee: Samsung Display Co., Ltd. (KR)

( * ) Notice: Subject to any disclaimer, the term of this patent is extended or adjusted under 35 U.S.C. 154(b) by 10 days.

(21) Appl. No.: 15/673,129

(22) Filed: Aug. 9, 2017

(65) Prior Publication Data

US 2018/0061357 A1 Mar. 1, 2018

(30) Foreign Application Priority Data

Aug. 25, 2016 (KR) ..... 10-2016-0108348

(51) Int. Cl.
*G09G 3/36* (2006.01)

(52) U.S. Cl.
CPC ..... *G09G 3/3688* (2013.01); *G09G 3/3614* (2013.01); *G09G 3/3648* (2013.01); *G09G 2300/0452* (2013.01)

(58) Field of Classification Search
CPC ..... G09G 2300/0452; G09G 3/2003; G09G 3/3688; G09G 3/3614
See application file for complete search history.

(56) References Cited

U.S. PATENT DOCUMENTS

2004/0189575 A1 9/2004 Choi et al.
2011/0012887 A1 1/2011 Lee et al.
2016/0189657 A1* 6/2016 Oh ..... G09G 3/3688 345/211
2017/0278446 A1* 9/2017 Ishiyama ..... G02F 1/134309
2017/0345382 A1* 11/2017 Sang ..... G02F 1/13

FOREIGN PATENT DOCUMENTS

KR 10-2004-0085495 A 10/2004
KR 10-2007-0003117 A 1/2007
KR 10-2008-0066333 A 7/2008
KR 10-2011-0006770 A 1/2011

* cited by examiner

*Primary Examiner* — Yuzhen Shen
(74) *Attorney, Agent, or Firm* — Innovation Counsel LLP

(57) ABSTRACT

A liquid crystal display device includes: a liquid crystal display panel including a red pixel, a green pixel, and a blue pixel connected to one data line; a data driver applying a data voltages; a data analyzing unit analyzing the data voltages; and a data modulation unit inverting a polarity of the data voltages. A first, second and third data voltage are applied to one of the red pixel, the green pixel, and the blue pixel, and when a difference between the first data voltage and a gamma reference voltage is less than a difference between each of the second and third data voltages and the gamma reference voltage, and a difference between the first data voltage and each of the second and third data voltages is a predetermined value or more, the data modulation unit inverts a polarity of the first data voltage.

8 Claims, 13 Drawing Sheets

LIQUID CRYSTAL DISPLAY DEVICE IMPROVING DISPLAY QUALITY AND DRIVING METHOD THEREOF

CROSS-REFERENCE TO RELATED APPLICATION

This application claims priority to Korean Patent Application No. 10-2016-0108348, filed on Aug. 25, 2016, and all the benefits accruing therefrom under 35 U.S.C. § 119, the content of which in its entirety is herein incorporated by reference.

BACKGROUND

1. Field

Exemplary embodiments of the invention relate to a liquid crystal display ("LCD") device and a method of driving the LCD device, and more particularly, to an LCD device improved in terms of display quality and to a method of driving the LCD device.

2. Description of the Related Art

Display devices are classified into a liquid crystal display ("LCD") device, an organic light emitting diode ("OLED") display device, a plasma display panel ("PDP") device, an electrophoretic display ("EPD") device, and the like, based on a light emitting scheme thereof.

An LCD device includes two substrates including a pixel electrode and a common electrode formed thereon and a liquid crystal layer interposed between the two substrates. Upon applying voltage to the pixel electrode and the common electrode, liquid crystal molecules of the liquid crystal layer are rearranged such that an amount of transmitted light is controlled in the LCD device.

In recent times, as LCD devices are being developed to achieve higher definition and a higher frame rate, one horizontal period 1H for charging a data voltage to a pixel electrode is shortened, resulting in display quality degradation problems due to insufficient charging rates in the case of a mixed color pattern which requires a great deal of data voltage change.

In particular, when displaying a mixed color pattern, which has a great deal of data voltage change, by using an LCD device having a pixel structure in which, e.g., red, green, blue, and white pixels are driven with a single data line, color expressions and color accuracy may be degraded.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Exemplary embodiments of the invention are directed to a liquid crystal display ("LCD") device that drives, e.g., red, green, blue, and white pixels with a single data line and to a method of driving the LCD device, in which display quality degradation that may occur due to insufficient charging rates when displaying a mixed color pattern may be improved.

According to an exemplary embodiment of the invention, a liquid crystal display device includes: a liquid crystal display panel comprising a red pixel, a green pixel, and a blue pixel disposed adjacent to one another and connected to one data line; a data driver configured to apply data voltages, wherein the data voltages comprise a data voltage of same polarities to be applied to the one data line; a data analyzing unit configured to analyze the data voltages to be applied to the red pixel, the green pixel, and the blue pixel, respectively; and a data modulation unit configured to invert a polarity of a plurality of polarities of the data voltages, wherein the data voltages comprise a first data voltage to be applied to one of the red pixel, the green pixel, and the blue pixel, and the data voltages comprises a second data voltage and third data voltage to each be applied to one of the others of the red pixel, the green pixel, and the blue pixel, respectively; and wherein, when a difference between the first data voltage and a gamma reference voltage is less than a difference between each of the second and third data voltages and the gamma reference voltage, and a difference between the first data voltage and each of the second and third data voltages is a predetermined value or more, the data modulation unit inverts a polarity of the first data voltage.

When a difference between the first data voltage and each of the second and third data voltages is in a range of about 5 V to about 8 V, the data modulation unit may invert the polarity of the first data voltage.

When the data voltage analyzed by the data analyzing unit corresponds to yellow, the first data voltage may be applied to the blue pixel.

When the data voltage analyzed by the data analyzing unit corresponds to magenta, the first data voltage may be applied to the green pixel.

When the data voltage analyzed by the data analyzing unit corresponds to cyan, the first data voltage may be applied to the red pixel.

The liquid crystal display device may further comprise a plurality of data lines comprising the one data line, and the data driver may apply line inverted data voltages to the plurality of data lines.

The plurality of pixels included in the liquid crystal display panel may be charged with line inverted data voltages with respect to the one data line.

According to an exemplary embodiment of the invention, a liquid crystal display device includes: a liquid crystal display panel comprising a red pixel, a green pixel, a blue pixel, and a white pixel disposed adjacent to one another and connected to one data line; a data driver configured to apply a data voltages, wherein the data voltages comprise a data voltage of same polarities to be applied to the one data line; a data analyzing unit configured to analyze the data voltages to be applied to the red pixel, the green pixel, the blue pixel, and the white pixel, respectively; and a data modulation unit configured to invert a polarity of a plurality of polarities of the data voltages applied to the red pixel, the green pixel, the blue pixel, and the white pixel, wherein the data voltages comprise a first data voltage to be applied to one of the red pixel, the green pixel, and the blue pixel, and the data voltages comprises a second data voltage, third data voltage, and fourth data voltage to each be applied to one of the others of the red pixel, the green pixel, the blue pixel, and the white pixel, respectively; and wherein, when a difference between the first data voltage and a gamma reference voltage is less than a difference between each of the second, third, and fourth data voltages and the gamma reference voltage, and a difference between the first data voltage and each of the second, third, and fourth data voltages is a predetermined value or more, the data modulation unit inverts a polarity of the first data voltage.

When a difference between the first data voltage and each of the second, third, and fourth data voltages is in a range of about 5 V to about 8 V, the data modulation unit may invert the polarity of the first data voltage.

When the data voltage analyzed by the data analyzing unit corresponds to yellow, the first data voltage may be applied to the blue pixel.

When the data voltage analyzed by the data analyzing unit corresponds to magenta, the first data voltage may be applied to the green pixel.

When the data voltage analyzed by the data analyzing unit corresponds to cyan, the first data voltage may be applied to the red pixel.

The liquid crystal display device may further comprise a plurality of data lines comprising the one data line, wherein the data driver may apply line inverted data voltages to the plurality of data lines.

The plurality of pixels included in the liquid crystal display panel may be charged with a line inverted data voltage with respect to the one data line.

According to an exemplary embodiment of the invention, a method of driving a liquid crystal display device including a red pixel, a green pixel, and a blue pixel connected to one data line includes: comparing a first data voltage applied to one of the red pixel, the green pixel, and the blue pixel with each of second and third data voltages respectively applied to the others of the red pixel, the green pixel, and the blue pixel that are adjacent thereto; applying the first, second, and third data voltages without modulation to respective corresponding ones of the red pixel, the green pixel, and the blue pixel when a difference between the first data voltage and a gamma reference voltage is greater than or equal to a difference between each of the second and third data voltages and the gamma reference voltage; and inverting a polarity of the first data voltage and applying the first, second, and third data voltages to respective corresponding ones of the red pixel, the green pixel, and the blue pixel when a difference between the first data voltage and the gamma reference voltage is less than a difference between each of the second and third data voltages and the gamma reference voltage and a difference between the first data voltage and each of the second and third data voltages is a predetermined value or more.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present disclosure of invention will be more clearly understood from the following detailed description taken in conjunction with the accompanying drawings, in which.

DETAILED DESCRIPTION

Figure 1:
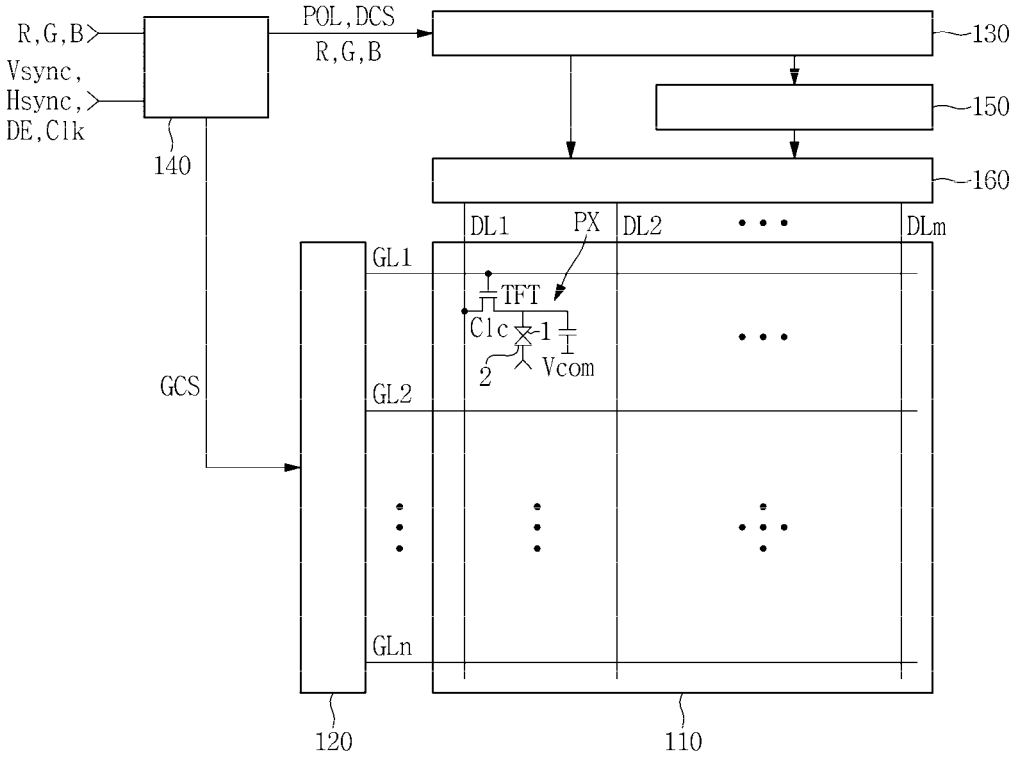
FIG. 1 is a schematic block diagram illustrating an exemplary embodiment of a liquid crystal display ("LCD") device.

Advantages and features of the invention and methods for achieving them will be made clear from exemplary embodiments described below in detail with reference to the accompanying drawings. The invention may, however, be embodied in many different forms and should not be construed as being limited to the exemplary embodiments set forth herein. Rather, these exemplary embodiments are provided so that this disclosure will be thorough and complete, and will fully convey the scope of the invention to those skilled in the art. The invention is merely defined by the scope of the claims. Therefore, well-known constituent elements, operations and techniques are not described in detail in the exemplary embodiments in order to prevent the invention from being obscurely interpreted. Like reference numerals refer to like elements throughout the specification.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween. Further when a layer, area, or plate is referred to as being "adjacent" to another layer, area, or plate, it may be directly adjacent to the other layer, area, or plate, or intervening layers, areas, or plates may be present therebetween. Conversely, when a layer, area, or plate is referred to as being "directly adjacent" to another layer, area, or plate, intervening layers, areas, or plates may be absent therebetween.

The spatially relative terms "below", "beneath", "less", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Some of the parts which are not associated with the description may not be provided in order to specifically describe embodiments of the present invention, and like reference numerals refer to like elements throughout the specification.

FIG. 1 is a schematic block diagram illustrating an exemplary embodiment of a liquid crystal display ("LCD") device.

Referring to FIG. 1, an exemplary embodiment of the LCD device may include an LCD panel 110, a gate driver 120, a data driver 130, a timing controller 140, a data analyzing unit 150, and a data modulation unit 160.

The LCD panel 110 may include a plurality of gate lines GL1 to GLn extending in one direction, a plurality of data lines DL1 to DLm extending in a direction which intersects the one direction, and a plurality of pixels PX connected to the gate line GL and the data line DL.

Each of the pixels PX may include a thin film transistor ("TFT") connected to the gate line GL and the data line DL, a pixel electrode 1 connected to the TFT, a storage capacitor Cst connected to the pixel electrode 1, a common electrode 2 opposing the pixel electrode 1, and a liquid crystal cell Clc interposed between the pixel electrode 1 and the common electrode 2. The common electrode 2 receives a common voltage Vcom.

The gate driver 120 may include a plurality of gate driving integrated circuits (ICs). The gate driver 120 applies a gate driving voltage sequentially to the plurality of gate lines GL1 to GLn in response to a gate control signal GCS applied from the timing controller 140.

The data driver 130 may include a plurality of data driving ICs. In response to a data control signal DCS and a polarity control signal POL applied from the timing controller 140, the data driver 130 samples image data R, G, and B applied from the timing controller 140, latches the sampled image data R, G, and B, and converts, with respect to a gamma reference voltage, the latched image data R, G, and B into analog data voltages that may represent a gray level in the liquid crystal cell Clc of the LCD panel 110.

The timing controller 140 receives the image data R, G, and B and a timing signal such as a vertical synchronization signal Vsync, a horizontal synchronization signal Hsync, a data enable signal DE, and a clock signal CLK from an external graphic controller (not illustrated).

The data analyzing unit 150 analyzes the data voltage applied from the data driver 130. For example, the data analyzing unit 150 analyzes the data voltage to verify if it is, or corresponds to, a mixed color pattern such as magenta, cyan, and yellow or a general pattern such as red, green, and blue. Hereinbelow, for ease of description, a pattern other than the mixed color pattern is to be referred to as a general pattern. Detailed descriptions of analyzing the data voltage in the data analyzing unit 150 will be described hereinbelow.

In a case where the data voltage analyzed by the data analyzing unit 150 corresponds to a mixed color pattern, the data modulation unit 160 inverts a polarity of the data voltage input from the data driver 130 and applies the data voltage with the inverted polarity to each of the data lines DL1 to DLm. Detailed descriptions of inverting the polarity of the data voltage in the data modulation unit 160 will be described hereinbelow.

Figure 2:
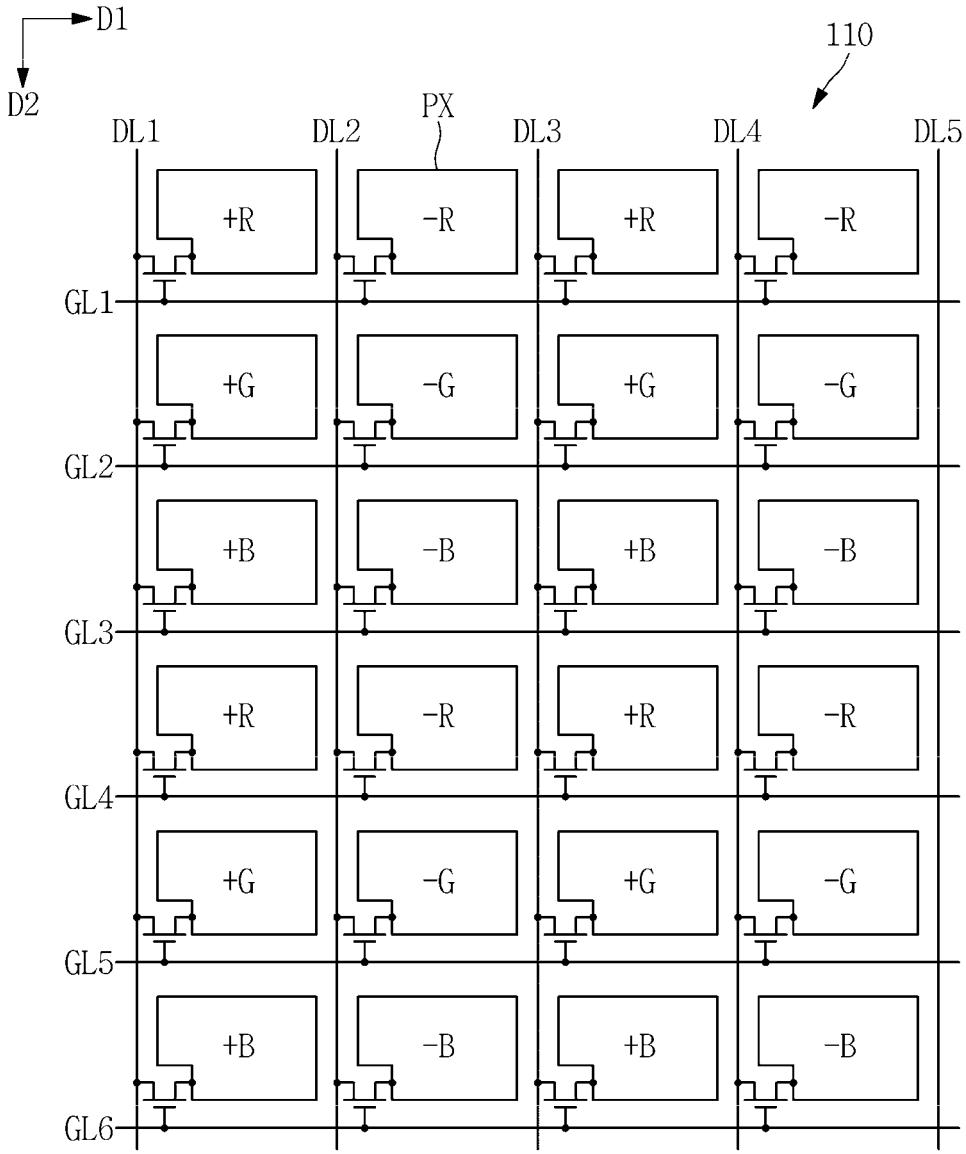
FIG. 2 is an equivalent circuit diagram illustrating a portion of an exemplary embodiment of an LCD panel.
Figure 3:
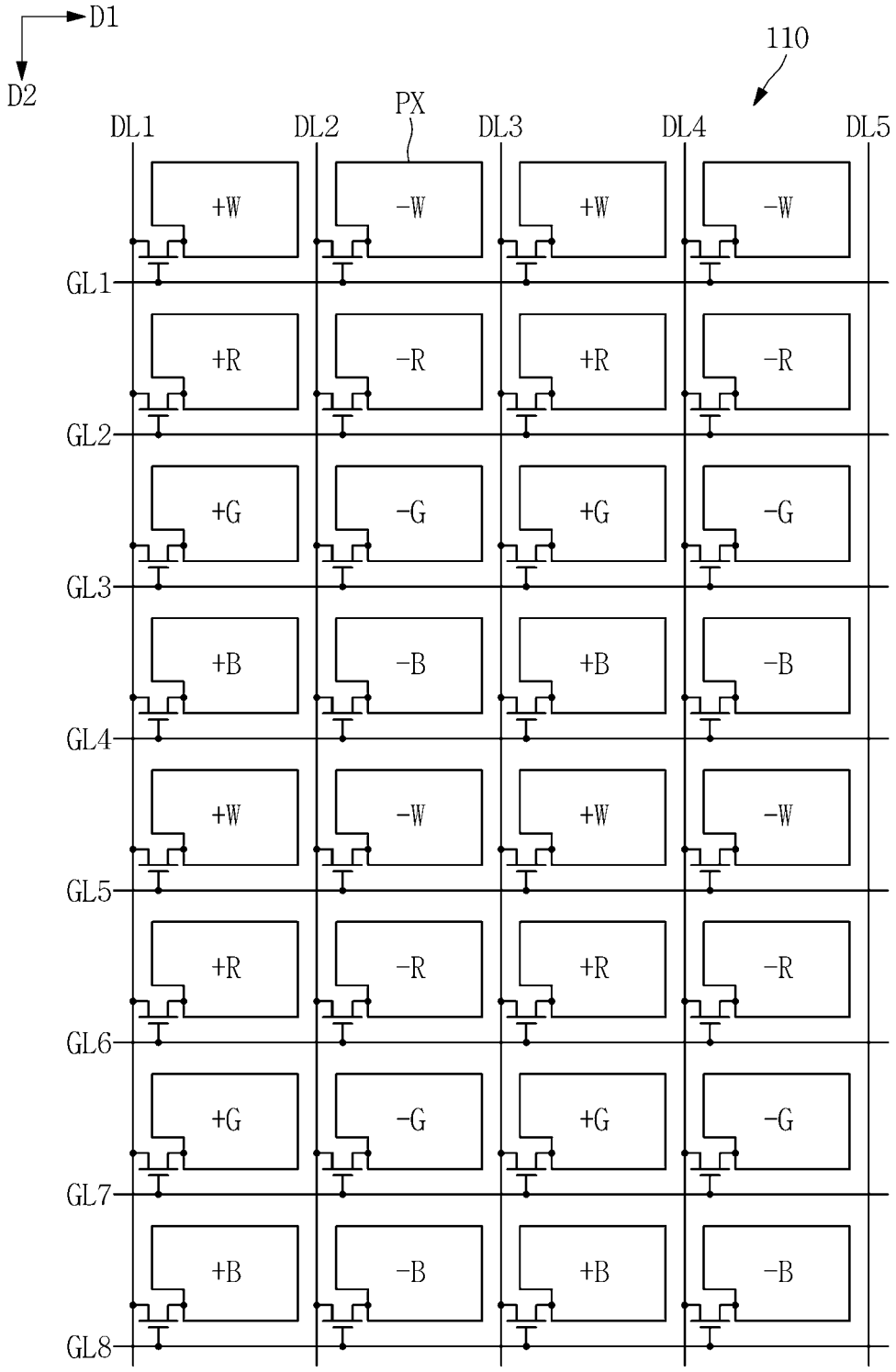
FIG. 3 is an equivalent circuit diagram illustrating a portion of an alternative exemplary embodiment of an LCD panel.

FIG. 2 is an equivalent circuit diagram illustrating a portion of an exemplary embodiment of an LCD panel, and FIG. 3 is an equivalent circuit diagram illustrating a portion of an alternative exemplary embodiment of an LCD panel.

Referring to FIG. 2, an exemplary embodiment of the LCD panel 110 includes a plurality of gate lines GL1, GL2, GL3, GL4, GL5, and GL6 extending in a first direction D1 (or a horizontal direction), a plurality of data lines DL1, DL2, DL3, DL4, and DL5 extending in a second direction D2 (or a vertical direction) which intersects the first direction D1, and a plurality of pixels PX connected to the gate line GL and the data line DL.

An exemplary embodiment of the LCD panel 110 may include a red pixel R, a green pixel G, and a blue pixel B connected to a single data line DL, but exemplary embodiments are not limited thereto. Referring to FIG. 3, an alternative exemplary embodiment of an LCD panel may include a red pixel R, a green pixel G, a blue pixel B, and a white pixel W connected to a single data line DL.

The red pixel R, the green pixel G, and the blue pixel B are alternately disposed and adjacent to one another along the first direction D1 and pixels PX of a same color may be disposed along the second direction D2.

Each of the plurality of pixels PX may have a longer length in the first direction D1 than a length in the second direction D2. That is, the pixel PX may have a shape lengthened in the horizontal direction. As such, when each of the plurality of pixels PX has a shape lengthened in the horizontal direction, as compared to a case where each of the plurality of pixels PX has a shape lengthened in the vertical direction, the number of data lines required at the same resolution may be reduced to about ⅓, and the number of data driving ICs required at the same resolution may be reduced to about ⅓.

In an exemplary embodiment, the plurality of pixels PX may be charged with a polarity inverted data voltage with respect to the data line DL. For example, a positive data voltage may be applied to odd-numbered data lines DL1, DL3, and DL5, and a negative data voltage may be applied to even-numbered data lines DL2 and DL4. That is, a line inverted data voltage may be charged with respect to the data line DL.

Figure 4:
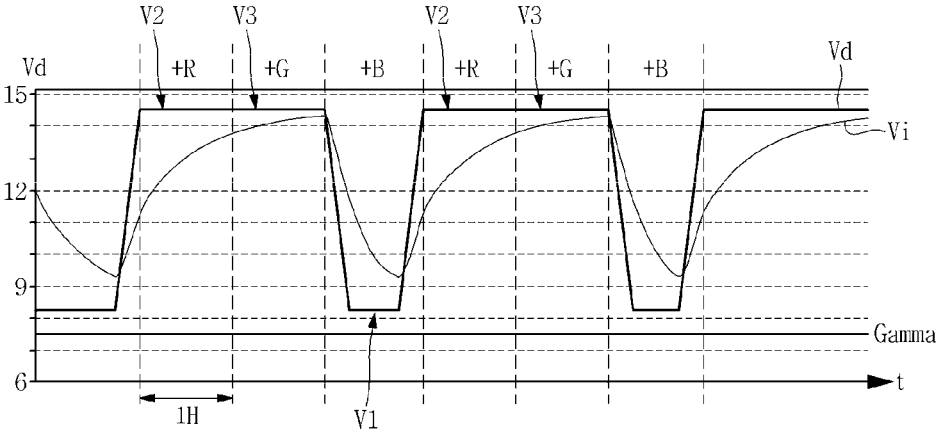
FIG. 4 is a waveform diagram illustrating a data voltage and a pixel charging voltage for a conventional mixed color pattern.
Figure 5:
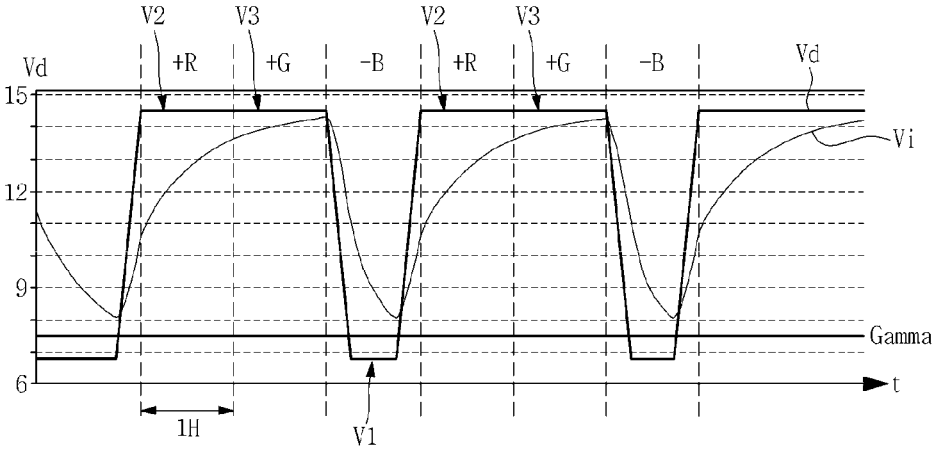
FIG. 5 is a waveform diagram illustrating a data voltage and a pixel charging voltage for an exemplary embodiment of a mixed color pattern.

FIG. 4 is a waveform diagram illustrating a data voltage and a pixel charging voltage for a conventional mixed color pattern, and FIG. 5 is a waveform diagram illustrating a data voltage and a pixel charging voltage for an exemplary embodiment of a mixed color pattern.

In detail, FIG. 4 illustrates a waveform diagram of a data voltage Vd applied to one data line to display a mixed color pattern and a charging voltage Vi substantially input to an actual pixel, in an LCD device including a red pixel R, a green pixel G, and a blue pixel B connected to a single data line.

Examples of the mixed color pattern may include magenta, cyan, and yellow. When a data voltage applied to one of the red pixel R, the green pixel G, and the blue pixel B is defined as a first data voltage V1, and data voltages applied to the others of the red pixel R, the green pixel G, and the blue pixel B are defined as a second data voltage V2 and a third data voltage V3, respectively, for ease of description, a case in which a difference between the first data voltage V1 and a gamma reference voltage Gamma is less than a difference between each of the second and third data voltages V2 and V3 and the gamma reference voltage Gamma, and the first data voltage V1 is higher than or lower than each of the second and third data voltages V2 and V3 by a predetermined voltage level or more may correspond to the case of the mixed color pattern. For example, a case in which a difference between the first data voltage V1 and each of the second and third data voltages V2 and V3 is in a range of about 5 V to about 8 V may correspond to the case of the mixed color pattern.

For example, in order to represent magenta, voltages higher than the gamma reference voltage Gamma may be applied to the red pixel R and the blue pixel B, and a voltage lower than the gamma reference voltage Gamma may be applied to the green pixel G.

Similarly, in order to represent cyan, voltages higher than the gamma reference voltage Gamma may be applied to the green pixel G and the blue pixel B, and a voltage lower than the gamma reference voltage Gamma may be applied to the red pixel R.

Similarly, in order to represent yellow, voltages higher than the gamma reference voltage Gamma may be applied to the red pixel R and the green pixel G and a voltage lower than the gamma reference voltage Gamma may be applied to the blue pixel B.

However, as LCD devices are being developed to achieve higher definition and a higher frame rate, one horizontal period 1H for charging a data voltage to a pixel electrode is shortened such that issues may arise whereby the charging voltage Vi input to an actual pixel may not accord with the data voltage Vd in the case of the mixed color pattern which has a great deal of voltage change.

For example, although voltages higher than the gamma reference voltage Gamma need to be applied to the red pixel R and the green pixel G and a voltage lower than the gamma reference voltage Gamma needs to be applied to the blue pixel B in order to render a yellow color, since the blue pixel B may not be charged with a sufficiently low voltage, a yellowish color partially mixed with a blue color may be displayed rather than a desired yellow color. Such an issue may also arise in the cases of other mixed color patterns such as magenta and cyan.

Accordingly, in an exemplary embodiment, when displaying a mixed color pattern, such as magenta, cyan, and yellow, by using an LCD device that includes a red pixel R, a green pixel G, and a blue pixel B connected to a single data line, a modulated data voltage is applied as illustrated in FIG. 5, whereby a polarity of the first data voltage V1 is inverted while polarities of the second and third data voltages V2 and V3 are maintained. That is, in the case of the mixed color pattern, an output data voltage may be applied in a 2-1 dot inversion scheme.

When displaying a mixed color pattern, e.g., yellow, data voltages of a non-inverted polarity are applied to the red pixel R and the green pixel G and a data voltage of an inverted polarity is applied to the blue pixel B. Accordingly, the blue pixel B may be charged with a sufficiently low voltage, and a desired yellow color may be distinctly represented. The above descriptions may be applied to other mixed color patterns such as magenta or cyan.

Referring to FIGS. 1 and 5, the data analyzing unit 150 analyzes the data voltage applied from the data driver 130. When a data voltage applied to one of the red pixel R, the green pixel G, and the blue pixel B is defined as a first data voltage V1, and data voltages applied to the others of the red pixel R, the green pixel G, and the blue pixel B are defined as a second data voltage V2 and a third data voltage V3, respectively, in a case where a difference between the first data voltage V1 and the gamma reference voltage Gamma is less than a difference between each of the second and third data voltages V2 and V3 and the gamma reference voltage Gamma, and the first data voltage V1 is higher than or lower than each of the second and third data voltages V2 and V3 by a predetermined voltage level or more, the data analyzing unit 150 may verify that the data voltage applied from the data driver 130 corresponds to the mixed color pattern.

Subsequently, when the data voltage corresponds to the mixed color pattern, the data modulation unit 160 inverts the polarity of the first data voltage V1 and maintains the polarities of the second and third data voltages V2 and V3 to apply the modulated data voltages V1, V2, and V3 to the data line DL.

That is, when an exemplary embodiment of the LCD device displays the mixed color pattern, a data voltage is applied in a 2-1 dot inversion scheme with respect to a single data line.

Figure 6:
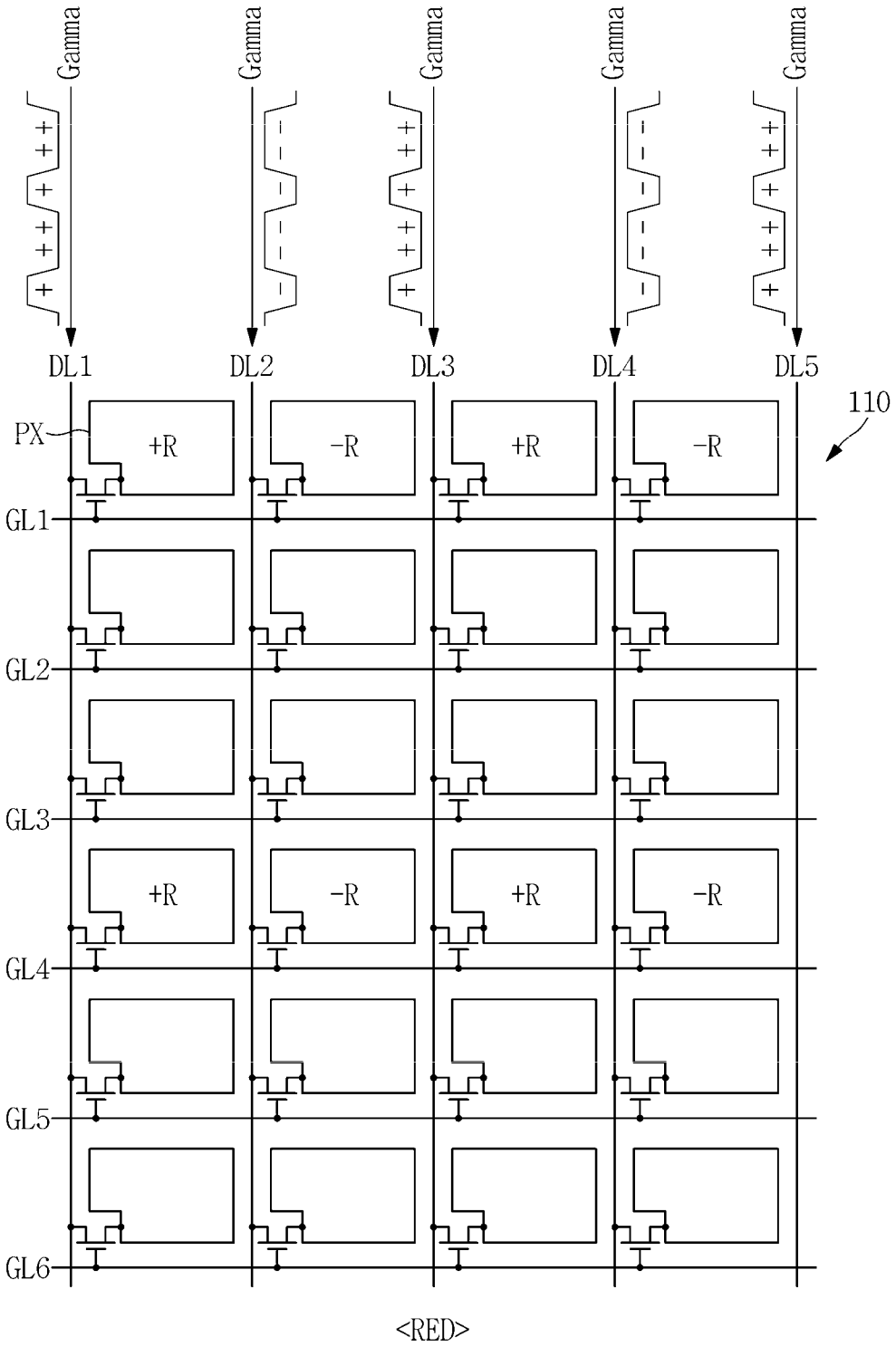
FIGS. 6, 7, and 8 are schematic diagrams illustrating an exemplary embodiment of a driving method in the case of a general pattern.
Figure 7:
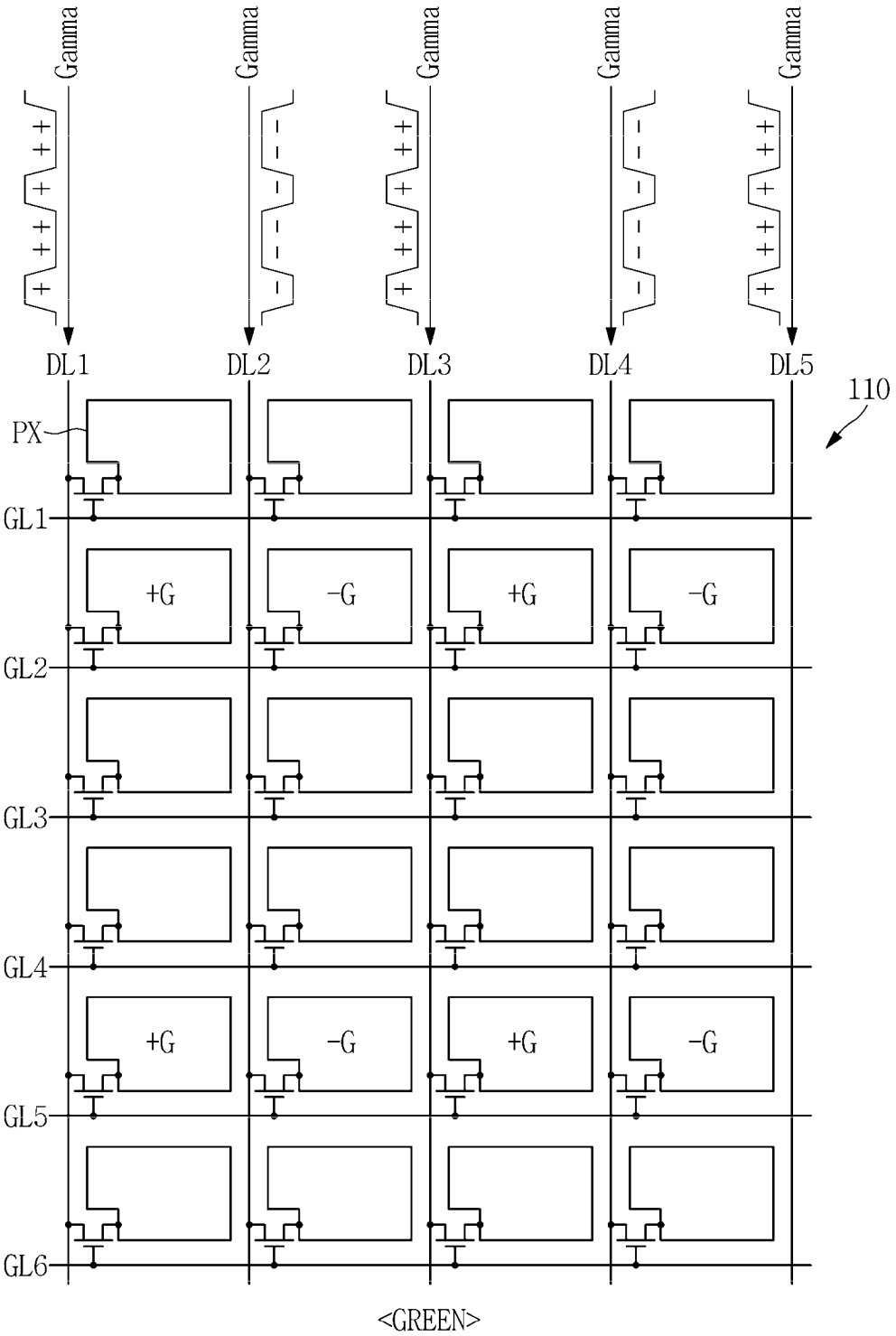
Figure 8:
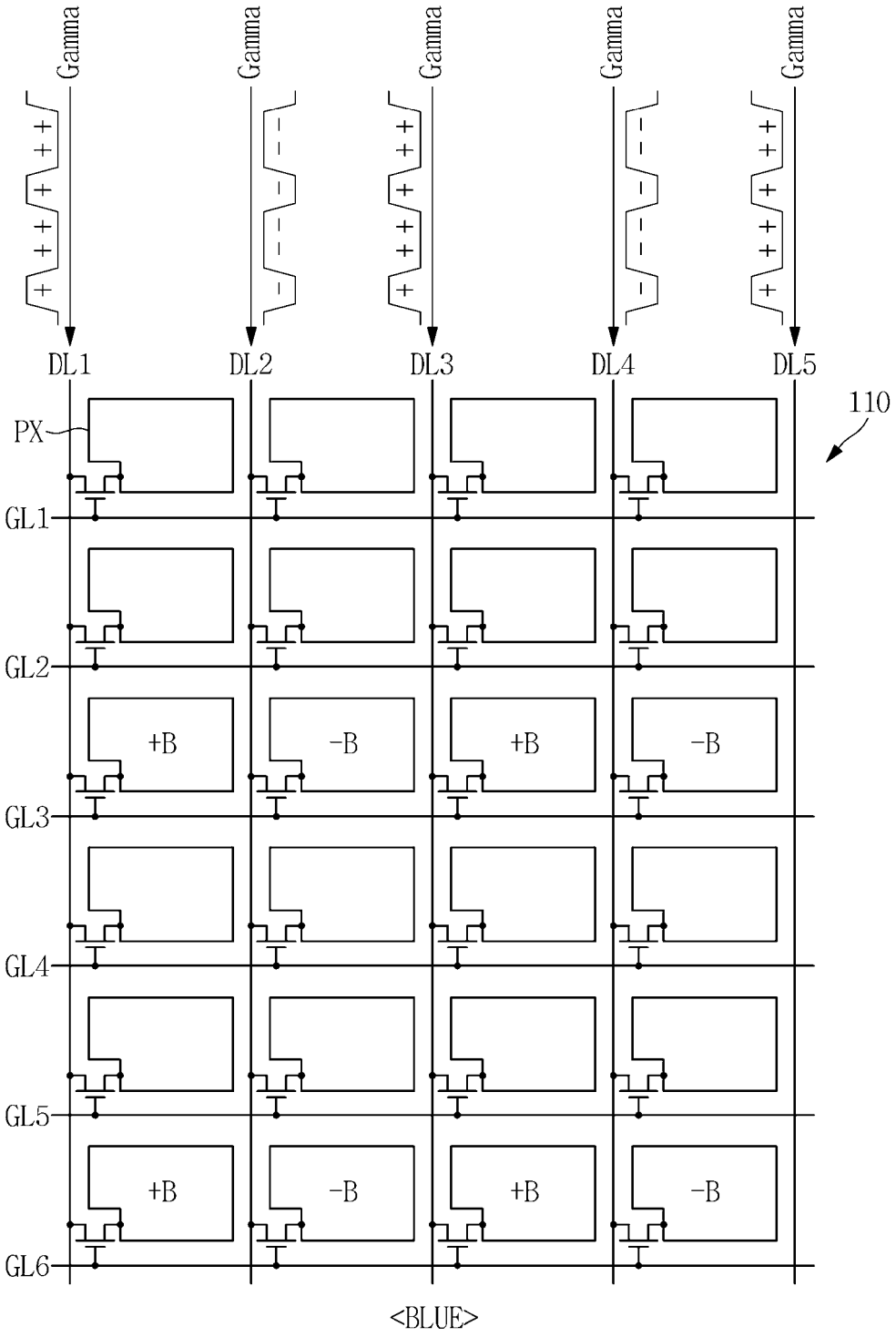

FIGS. 6, 7, and 8 are schematic diagrams illustrating an exemplary embodiment of a driving method in the case of a general pattern.

Referring to FIG. 6, in order to represent red, with respect to a single data line, a data voltage higher than the gamma reference voltage Gamma is applied to the red pixel R and data voltages lower than data voltage applied to the red pixel R, but higher than the gamma reference voltage Gamma, are applied to the green pixel G and the blue pixel B.

In addition, the data voltage may be line-inverted with respect to the data line DL. For example, a positive data voltage may be applied to odd-numbered data lines DL1, DL3, and DL5, and a negative data voltage may be applied to even-numbered data lines DL2 and DL4.

Referring to FIG. 7, in order to represent green, with respect to a single data line, a data voltage higher than the gamma reference voltage Gamma is applied to the green pixel G and data voltages lower than the data voltage applied to the green pixel G, but higher than the gamma reference voltage Gamma, are applied to the red pixel R and the blue pixel B. In addition, the data voltage may be line-inverted with respect to the data line DL.

Referring to FIG. 8, in order to represent blue, with respect to a single data line, a data voltage higher than the gamma reference voltage Gamma is applied to the blue pixel B and data voltages lower than the data voltage applied to the blue pixel B, but higher than the gamma reference voltage Gamma, are applied to the red pixel R and the green pixel G. In addition, the data voltage may be line-inverted with respect to the data line DL.

Figure 9:
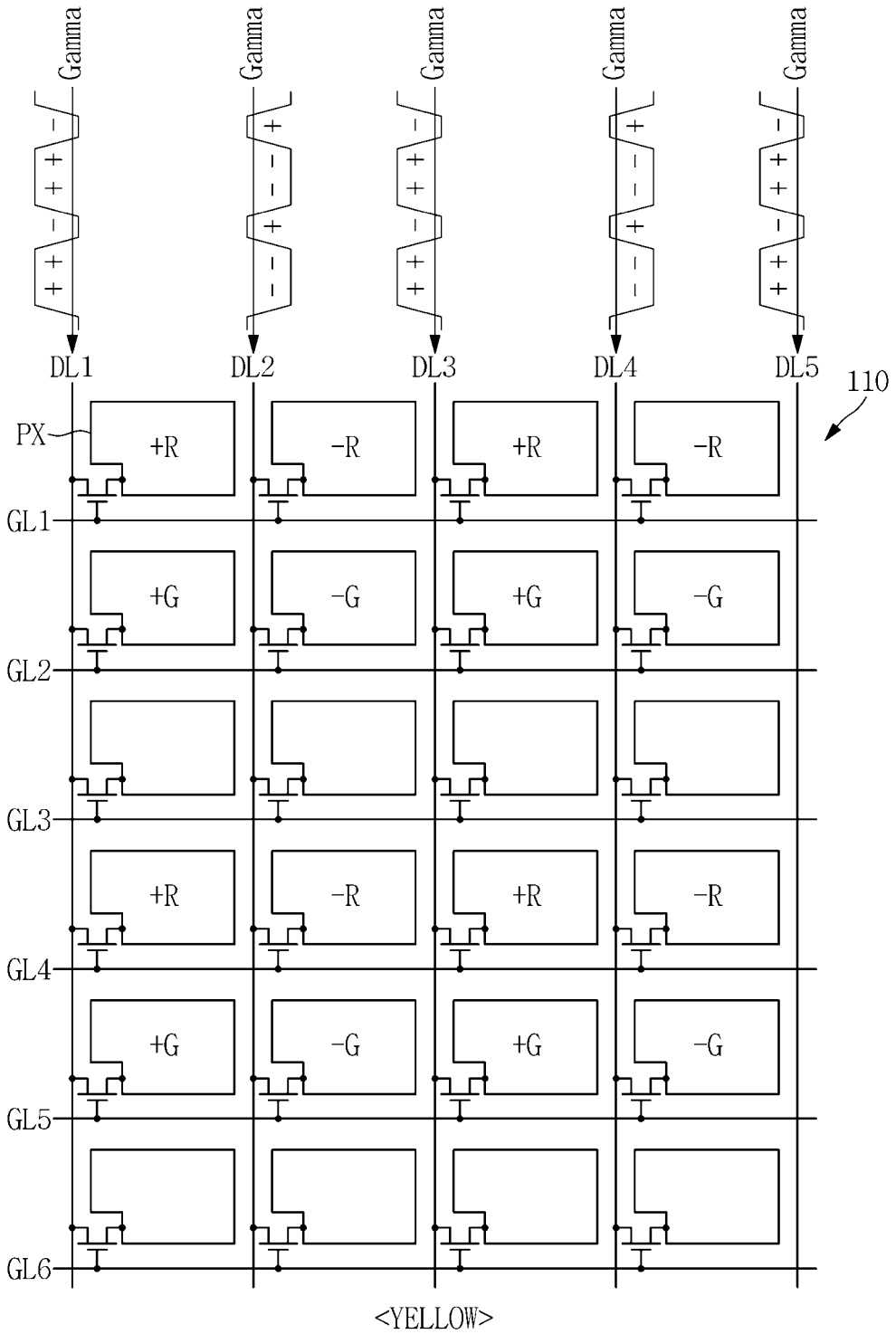
FIGS. 9, 10, and 11 are schematic diagrams illustrating an exemplary embodiment of a driving method in the case of a mixed color pattern.
Figure 10:
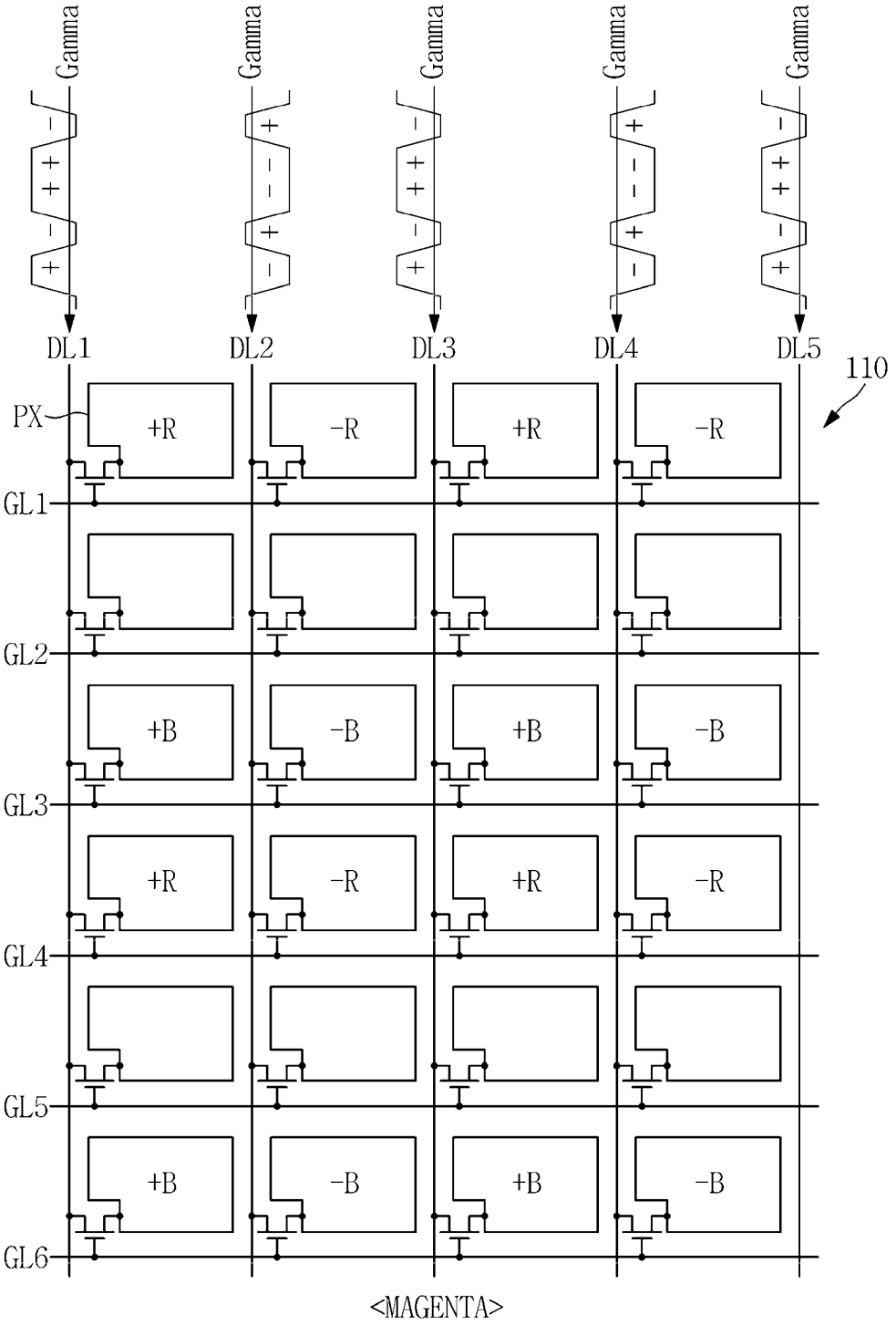
Figure 11:
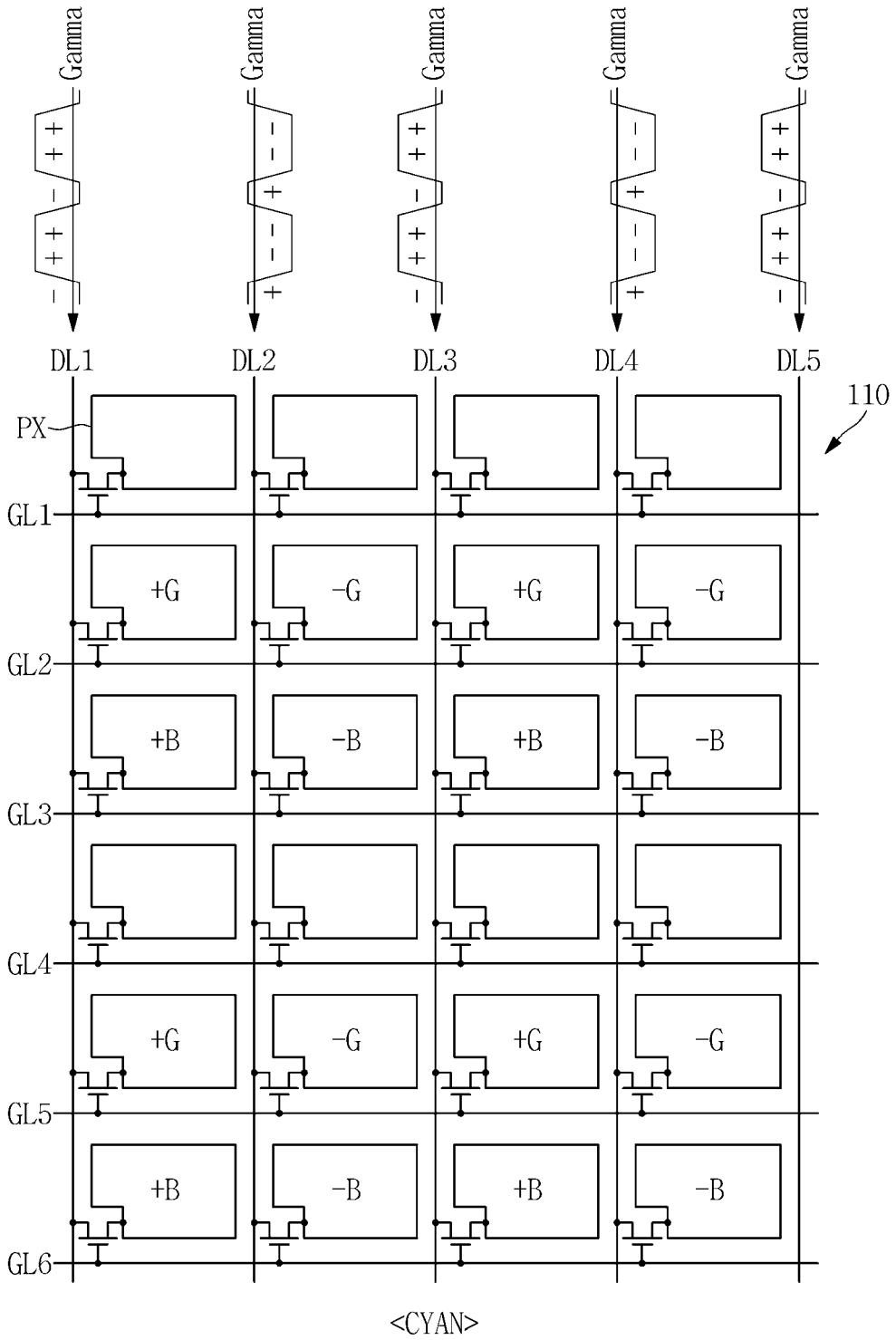

FIGS. 9, 10, and 11 are schematic diagrams illustrating an exemplary embodiment of a driving method in the case of a mixed color pattern.

Referring to FIG. 9, in order to represent yellow, with respect to a single data line, data voltages higher than the gamma reference voltage Gamma are applied to the red pixel R and the green pixel G, and a data voltage lower than the gamma reference voltage Gamma is applied to the blue pixel B, having an inverted polarity. That is, a data voltage is applied in a 2-1 dot inversion scheme with respect to a single data line. In addition, the data voltage may be line inverted with respect to the data line DL.

Referring to FIG. 10, in order to represent magenta, with respect to a single data line, data voltages higher than the gamma reference voltage Gamma are applied to the red pixel R and the blue pixel B, and a data voltage lower than the gamma reference voltage Gamma is applied to the green pixel G, having an inverted polarity. That is, a data voltage is applied in a 2-1 dot inversion scheme with respect to a single data line. In addition, the data voltage may be line inverted with respect to the data line DL.

Referring to FIG. 11, in order to represent cyan, with respect to a single data line, data voltages higher than the gamma reference voltage Gamma are applied to the green pixel G and the blue pixel B, and a data voltage lower than the gamma reference voltage Gamma is applied to the red pixel R, having an inverted polarity. That is, a data voltage is applied in a 2-1 dot inversion scheme with respect to a single data line. In addition, the data voltage may be line inverted with respect to the data line DL.

Figure 12:
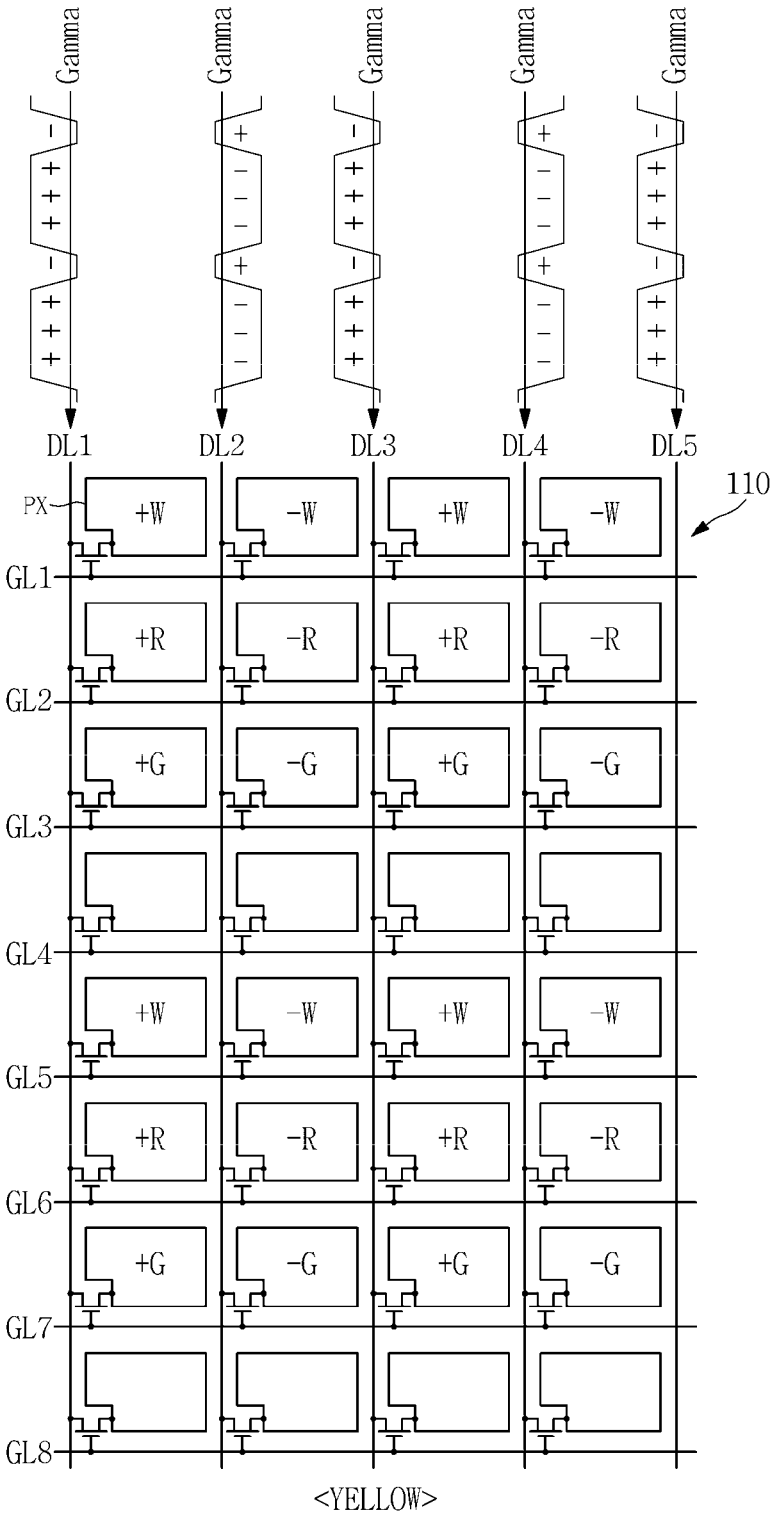
FIGS. 12, 13, and 14 are schematic diagrams illustrating an alternative exemplary embodiment of a driving method in the case of a mixed color pattern.
Figure 13:
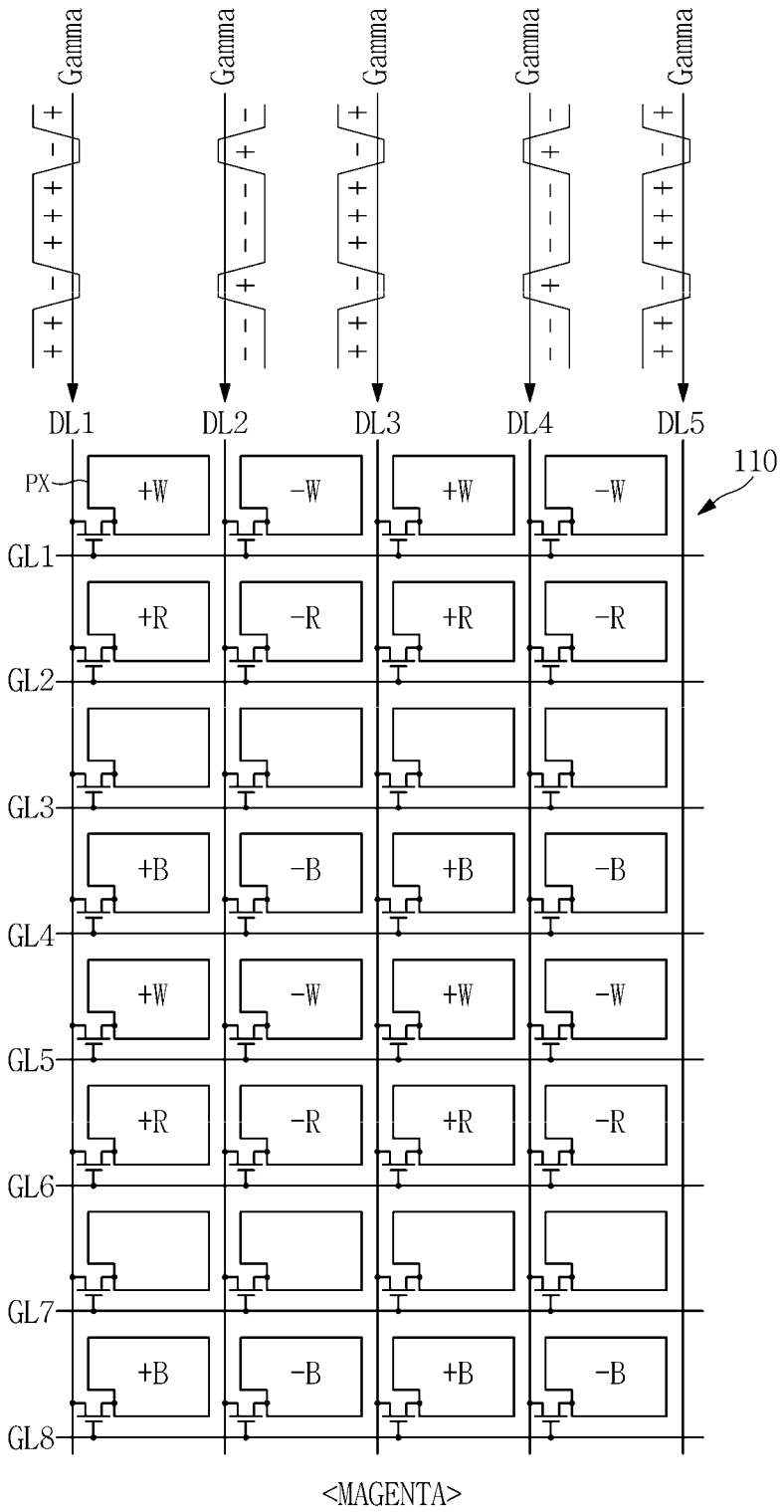
Figure 14:
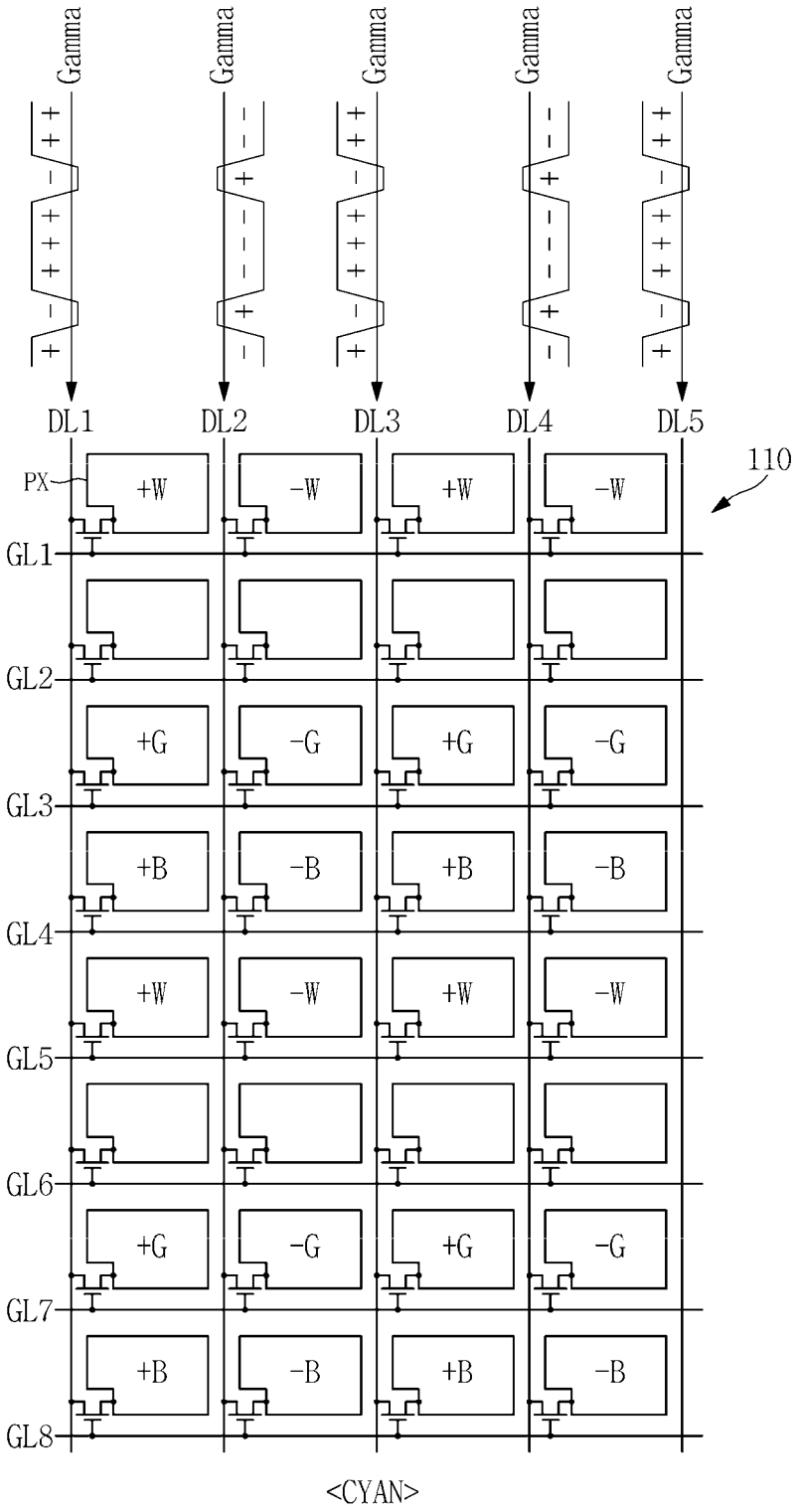

FIGS. 12, 13, and 14 are schematic diagrams illustrating an alternative exemplary embodiment of a driving method in the case of a mixed color pattern. An alternative exemplary embodiment of a driving method in the case of a general pattern is substantially the same as an exemplary embodiment of a driving method in the case of a general pattern, and thus descriptions pertaining thereto will be omitted.

Referring to FIG. 12, in order to represent yellow, with respect to a single data line, data voltages higher than the gamma reference voltage Gamma are applied to the red pixel R, the green pixel G, and the white pixel W, and a data voltage lower than the gamma reference voltage Gamma is applied to the blue pixel B, having an inverted polarity. That is, a data voltage is applied in a 3-1 dot inversion scheme with respect to a single data line. In addition, the data voltage may be line inverted with respect to the data line DL.

Referring to FIG. 13, in order to represent magenta, with respect to a single data line, data voltages higher than the gamma reference voltage Gamma are applied to the red pixel R, the blue pixel B, and the white pixel W, and a data voltage lower than the gamma reference voltage Gamma is applied to the green pixel G, having an inverted polarity. That is, a data voltage is applied in a 3-1 dot inversion scheme with respect to a single data line. In addition, the data voltage may be line inverted with respect to the data line DL.

Referring to FIG. 14, in order to represent cyan, with respect to a single data line, data voltages higher than the gamma reference voltage Gamma are applied to the green pixel G, the blue pixel B, and the white pixel W, and a data voltage lower than the gamma reference voltage Gamma is applied to the red pixel R, having an inverted polarity. That is, a data voltage is applied in a 3-1 dot inversion scheme with respect to a single data line. In addition, the data voltage may be line inverted with respect to the data line DL.

As set forth hereinabove, in one or more exemplary embodiments of an LCD device that drives, e.g., red, green, blue, and white pixels with a single data line and a method of driving the LCD device, display quality degradation that may occur due to insufficient charging rates when displaying a mixed color pattern may be improved.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings. Various features of the above described and other embodiments can be mixed and matched in any manner, to produce further embodiments consistent with the invention.

What is claimed is:

1. A liquid crystal display device comprising:

a liquid crystal display panel comprising a red pixel, a green pixel, and a blue pixel disposed adjacent to one another along a first direction and connected to one data line, each of the red pixel, the green pixel, and the blue pixel directly adjacent to at least one of the others of the red pixel, the green pixel, and the blue pixel along the first direction;

a data driver configured to apply data voltages, wherein the data voltages comprise a data voltage of same polarities to be applied to the one data line;

wherein the data voltages comprise a first data voltage to be applied to one of the red pixel, the green pixel, and the blue pixel, and the data voltages comprises a second data voltage and third data voltage to each be applied to one of the others of the red pixel, the green pixel, and the blue pixel, respectively, the data voltages sequentially applied according to a sequential order of an arrangement of the red pixel, the green pixel, and the blue pixel along the first direction; and wherein, when the first data voltage is less than each of the second and third data voltages, and a difference between the first data voltage and each of the second and third data voltages is a predetermined value or more, the first data voltage with inverted polarity is applied to the one of the red pixel, the green pixel, and the blue pixel, while the second data voltage and third data voltage without inverted polarity is applied to one of the others of the red pixel, the green pixel, and the blue pixel, respectively.

2. The liquid crystal display device of claim 1, wherein, when a difference between the first data voltage and each of the second and third data voltages is in a range of about 5 V to about 8 V, the first data voltage has an inverted polarity.

3. The liquid crystal display device of claim 1, wherein, when the data voltage corresponds to yellow, the first data voltage is applied to the blue pixel.

4. The liquid crystal display device of claim 1, wherein, when the data voltage corresponds to magenta, the first data voltage is applied to the green pixel.

5. The liquid crystal display device of claim 1, wherein, when the data voltage corresponds to cyan, the first data voltage is applied to the red pixel.

6. The liquid crystal display device of claim 1 further comprising a plurality of data lines comprising the one data line, wherein the data driver applies line inverted data voltages to the plurality of data lines.

7. The liquid crystal display device of claim 1, wherein the plurality of pixels included in the liquid crystal display panel are charged with line inverted data voltages with respect to the one data line.

8. A method of driving a liquid crystal display device comprising a red pixel, a green pixel, and a blue pixel disposed adjacent to one another along a first direction connected to one data line, the method comprising:

comparing a first data voltage applied to one of the red pixel, the green pixel, and the blue pixel with each of second and third data voltages respectively applied to the others of the red pixel, the green pixel, and the blue pixel that are adjacent thereto;

applying the first, second, and third data voltages without modulation to respective corresponding ones of the red pixel, the green pixel, and the blue pixel when a difference between the first data voltage and a gamma reference voltage is greater than or equal to a difference between each of the second and third data voltages and the gamma reference voltage; and inverting a polarity of the first data voltage and not inverting a polarity of the second and third data voltages and applying the first, second, and third data voltages to respective corresponding ones of the red pixel, the green pixel, and the blue pixel when the first data voltage is less than each of the second and third data voltages and a difference between the first data voltage and each of the second and third data voltages is a predetermined value or more, wherein each of the red pixel, the green pixel, and the blue pixel are directly adjacent to at least one of the others of the red pixel, the green pixel, and the blue pixel along the first direction, wherein the first, second, and third data voltages are sequentially applied according to a sequential order of an arrangement of the red pixel, the green pixel, and the blue pixel along the first direction.

* * * * *